US007312688B2

(12) United States Patent
Ely et al.

(10) Patent No.: US 7,312,688 B2
(45) Date of Patent: Dec. 25, 2007

(54) FUSE ELEMENT AND METHOD FOR MAKING SAME

(75) Inventors: Brian Ely, Worcester (GB); Gaël Arnaud, Courville/Eure (FR)

(73) Assignee: Metalor Technologies International S.A., Neuchatel (CH)

( * ) Notice: Subject to any disclaimer, the term of this patent is extended or adjusted under 35 U.S.C. 154(b) by 285 days.

(21) Appl. No.: 10/491,525

(22) PCT Filed: Sep. 20, 2002

(86) PCT No.: PCT/CH02/00520

§ 371 (c)(1),
(2), (4) Date: Sep. 29, 2004

(87) PCT Pub. No.: WO03/030199

PCT Pub. Date: Apr. 10, 2003

(65) Prior Publication Data

US 2005/0040926 A1 Feb. 24, 2005

(30) Foreign Application Priority Data

Oct. 3, 2001 (EP) ..... 01810962

(51) Int. Cl.
*H01H 85/11* (2006.01)
*H01H 85/08* (2006.01)

(52) U.S. Cl. ..... 337/160; 337/159

(58) Field of Classification Search ..... 337/152, 337/159, 160

See application file for complete search history.

(56) References Cited

U.S. PATENT DOCUMENTS

| | | | | |
|---|---|---|---|---|
| 3,543,209 | A * | 11/1970 | Kozacka | 337/159 |
| 3,671,909 | A * | 6/1972 | Kozacka et al. | 337/160 |
| 3,838,376 | A | 9/1974 | Norholm | 337/296 |
| 4,134,094 | A | 1/1979 | Huber | 337/292 |
| 4,219,795 | A * | 8/1980 | Panaro et al. | 337/296 |

(Continued)

FOREIGN PATENT DOCUMENTS

| | | |
|---|---|---|
| FR | 2.170.204 | 9/1973 |

(Continued)

OTHER PUBLICATIONS

Translation of PCT International Preliminary Examination Report.

(Continued)

*Primary Examiner*—Anatoly Vortman
(74) *Attorney, Agent, or Firm*—Townsend M. Belser, Jr.; Nexsen Pruet Adams Kleemeier, LLC

(57) ABSTRACT

A fuse element strip with a central metallic section having a part with a high melting point and a part with a low melting point embedded in the high melting point part, and two lateral metallic sections with a high melting point. Each lateral section is joined to the high melting point part of the central section by a weld of fused material, and the joined sections have the same thickness so that the strip has three coplanar sections. The high melting point and low melting point parts of the central metallic section alloy at the low melting point causing the strip to melt at the melting temperature of the alloy.

22 Claims, 1 Drawing Sheet

U.S. PATENT DOCUMENTS

| | | | | | |
|---|---|---|---|---|---|
| 4,300,281 | A | * | 11/1981 | Panaro | 29/623 |
| 4,308,514 | A | * | 12/1981 | Kozacka | 337/159 |
| 4,315,235 | A | * | 2/1982 | Jacobs, Jr. | 337/296 |
| 4,357,588 | A | * | 11/1982 | Leach et al. | 337/160 |
| 5,898,357 | A | * | 4/1999 | Endo et al. | 337/159 |
| 6,570,482 | B2 | * | 5/2003 | Brown et al. | 337/160 |
| 6,622,375 | B1 | * | 9/2003 | Endo et al. | 29/623 |

FOREIGN PATENT DOCUMENTS

| | | |
|---|---|---|
| GB | 2120027 A | 11/1983 |
| WO | WO 82/02795 | 7/1985 |

OTHER PUBLICATIONS

Search Report published with the PCT application.

* cited by examiner

FUSE ELEMENT AND METHOD FOR MAKING SAME

BACKGROUND OF THE INVENTION

1. Field of the Invention

The present invention relates to the technology of fuses. More particularly, it relates to a flat fuse element—or strip—designed, especially, to react to overload currents of low magnitude but of long duration. The invention also relates to a method for the manufacture of such a fuse element.

2. Discussion of Related Art

To manufacture this type of fuse, it is known to deposit a small bead of a metal with a low melting point, such as tin, denoted by the expression "M-spot", at the center of a silver ribbon which reacts in a conventional way to high overload currents (short circuits) but remains insensitive to low overload currents of long duration.

When a low overload current flows in the silver ribbon for a long period of time, its temperature increases progressively until it melts the small bead of tin. The alloying of the silver with the tin produces a eutectic having a much lower melting point than silver but with an electrical resistance high enough to cause the strip to meet at this point. Typically, this "M-spot" structure allows melting to take place at a temperature of 200 to 300° C., whereas the normal melting point of silver is 962° C.

Documents CH 587 559, U.S. Pat. No. 4,134,094 and GB 2 120 027, for example, describe structures of this type.

SUMMARY OF THE INVENTION

It is an object of the present invention is to provide a fuse element structure in the form of a strip that, notably, improves the efficiency of the "M-spot" effect and greatly simplifies its manufacture.

In order to achieve this object, the fuse element according to the invention consists of a strip structure comprising, at least, three coplanar sections having the same thickness that are clad-welded together by fusing them, namely:

- a central metallic section comprising a part with a high melting point and a part with a low melting point embedded in the part with a high melting point; and
- two lateral metallic sections with a high melting point.

It may be advantageous to adopt a structure in which the strip comprises, in series, a plurality of central sections each placed between two lateral sections.

In a first advantageous embodiment, the central section is composed of a core with a low melting point and of a sheath with a high melting point surrounding the core.

In a second advantageous embodiment, the central section is composed of a bundle of strands with a low melting point and of a matrix with a high melting point that surrounds the strands.

The fuse element according the invention further comprises the following main features:

- the part of the central section with a low melting point is mainly composed of tin;
- the part with a low melting point is an tin-silver or tin-zinc alloy containing from 80 to 98% tin;
- the part with a low melting point takes up from 15 to 60% by weight of the central section;
- the part of the central section with a high melting point is made of copper or silver;
- the lateral sections are made of copper or silver; and
- particularly advantageously, the lateral sections are made of copper and the part of the central section with a high melting point is made of silver.

The method according to the invention is characterized in that the fuse element sections are formed and clad-welded together by rolling.

Advantageously, the central section may originate either from a clad wire having a central core with a low melting point surrounded by a sheath with a high melting point, or from a composite wire formed from a bundle of strands with a low melting point that are embedded in a matrix with a high melting point.

BRIEF DESCRIPTION OF THE DRAWINGS

Further features and advantages of the present invention will be apparent "from the description that follows, presented with reference to the appended drawing, in which.

DETAILED DESCRIPTION OF THE INVENTION

Figure 1:
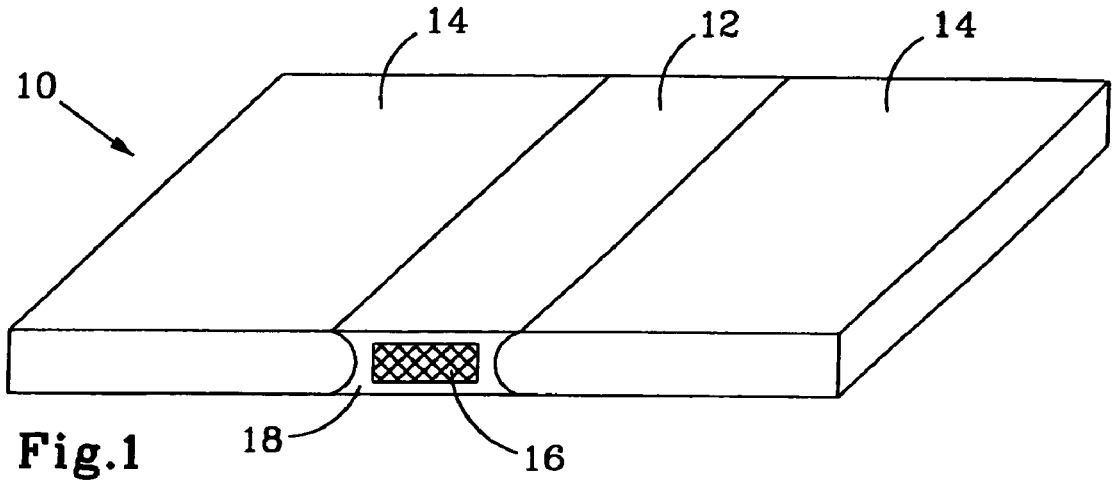
FIGS. 1 and 2 represent two embodiments of the fuse element.

With reference firstly to FIG. 1, this shows, a fuse element at 10, taking the form of a thin elongate strip typically having a length of 10 to 100 mm, a width of 2 to 15 mm and a thickness of 0.02 to 0.5 mm. In the conventional design, this strip usually has notches or holes in its cross-section in order to reduce the area so as to optimize the short-circuit behavior of the fuse.

The strip 10, cut from a ribbon, consists of three coplanar sections, juxtaposed along their length and clad-welded together by fusing them, namely:

- a central section 12 having, typically, a length of 2 to 10 mm, and
- two lateral sections 14.

The lateral sections 14 are made of a metal exhibiting good electrical conductivity and a high melting point, such as copper or silver.

In the embodiment of FIG. 1, the central section 12 is composed of a core 16, with an approximately rectangular cross-section, and a sheath 18 surrounding the core. The latter takes up 15 to 60% by weight of the central section 12, the sheath 18 therefore taking up 40 to 85%.

The core 16 is mainly formed from a metal with a low melting point, advantageously tin. As an illustration, it may be a tin-silver or tin-zinc alloy containing 80 to 98% tin.

The sheath 18 is mainly formed from a metal exhibiting good electrical conductivity and a high melting point, such as copper or silver.

Figure 2:
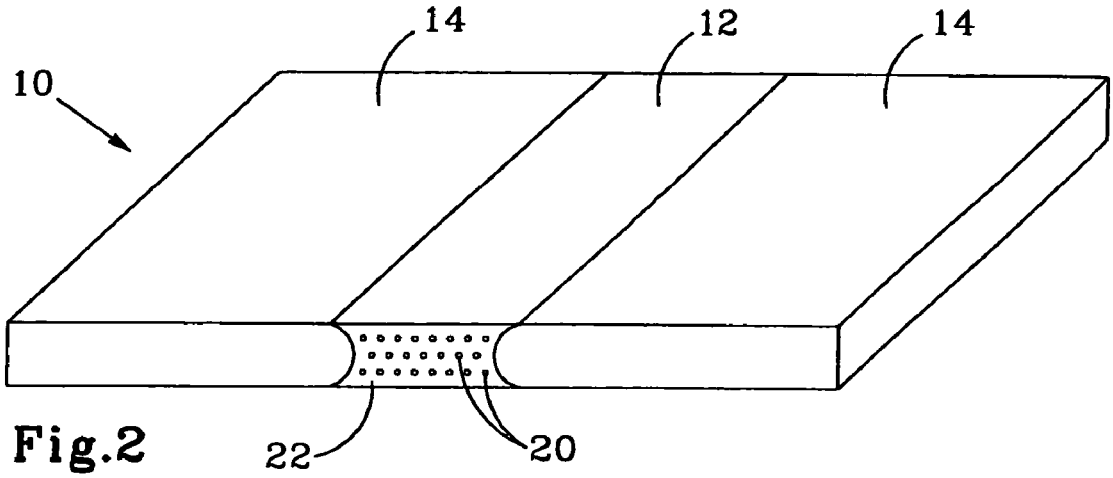

According to the embodiment represented in FIG. 2, the strip 10 still comprises a central section 12 and two lateral sections 14. These are identical to those of the embodiment in FIG. 1, but the central section 12 now consists of a bundle of strands 20 with a low melting point that are distributed within a matrix 22 having a high melting point.

The strands 20 take up 15 to 60% by weight of the central section 12, the matrix therefore taking up 40 to 85%.

The strands 20 are of the same nature as the core 16, and the matrix 22 of the same nature as the sheath 18.

Thus, a fuse element according to two different embodiments illustrated in FIGS. 1 and 2 is obtained in which the "M-spot" is intimately integrated into its copper or silver part that is sensitive to high overload currents.

It is to be noted that, according to one especially advantageous embodiment of the invention, the two lateral sections are made of copper, while the part of the central section with a high melting point is made of silver.

This structure, which considerably increases the contact area between the tin and the silver or copper, means that the formation of the eutectic with a low melting point comes into play more rapidly than in the case of the structures of the prior art which use a small bead of tin simply deposited onto the fuse. The efficiency of the "M-spot" is thus greatly increased. The amount of material required is therefore reduced, which leads to a reduction in the production cost of the fuse. Furthermore, since the sensitive element no longer has the bump formed by the bead of tin, it is easier to manipulate.

The manufacture of the fuse element described above makes use of rolling techniques, which are well known to those skilled in the art. Therefore, it suffices to mention here that two copper or silver ribbons are used to constitute the lateral sections 14 and, for the central section 12, either a clad wire having a tin core surrounded by a silver or copper sheath, or a composite wire formed from a bundle of tin strands embedded in a silver or copper matrix. The rolling thus allows the two ribbons and the wire to fuse together by squashing them and then to be rolled down to the required thickness. The ribbon that results from these operations is finally cut across its width in order to obtain the strips that are represented in the figures.

When the rolled structure has copper on the outside and silver on the inside, it is interesting to note that, at their junction with the silver central section 12, the two copper lateral sections 14 have convex edges. This results simply from the fact that the silver of the central section is softer than the copper of the lateral sections. During the rolling process, the latter therefore encroaches into the central section.

Figure 3:
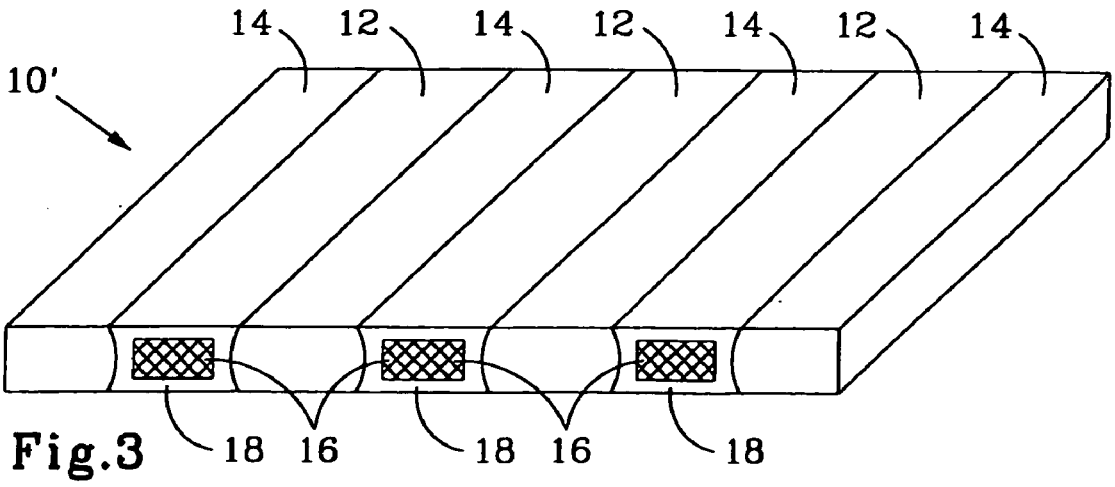
FIG. 3 represents a fuse element having several central sections.

Finally, with reference to FIG. 3, this shows a strip 10' according to the invention comprising several central sections 12, numbering three in the embodiment represented, each inserted between two lateral sections 14. These central sections 12 may consist of either a core 16 and a sheath 18 surrounding it, as shown in FIG. 3, or of a bundle of strands 20 that are distributed in a matrix 22, as shown in FIG. 2. This type of structure may be preferred for certain applications, notably on account of its faster response to overloads.

What is claimed is:

1. A fuse element having the form of a strip and comprising:

a central metallic section having a part with a high melting point and a part with a low melting point embedded in the part with the high melting point; and, two lateral metallic sections with a high melting point, one of which in on one side and the other one of which is on another side of said central section;

each of said lateral sections being joined to the high melting point part of said central section by a weld of fused material, said joined sections having the same thickness so that said strip has three coplanar sections, and the high melting point part and low melting point part of said central metallic section being adapted to alloy at said low melting point and thereby produce a eutectic that causes the strip to melt at a lower temperature than the high melting point part of said central metallic section.

2. The fuse element as claimed in claim 1, wherein said strip comprises, in series, a plurality of central sections and a plurality of lateral sections alternating with said central sections.

3. The fuse element as claimed in claim 1, wherein the central section is composed of a core with a low melting point and a sheath with a high melting point surrounding said core.

4. The fuse element as claimed in claim 1, wherein the central section is composed of a bundle of strands with a low melting point and of a matrix with a high melting point that surrounds said strands.

5. The fuse element as claimed in claim 1, wherein the part of the central section with a low melting point is mainly composed of tin.

6. The fuse element as claimed in claim 5, wherein the part with a low melting point is a tin-silver or tin-zinc alloy containing from 80 to 98% tin.

7. The fuse element as claimed in claim 1, wherein the part with a low melting point takes up from 15 to 60% by weight of the central section.

8. The fuse element as claimed in claim 1, wherein the part of the central section with a high melting point is made of copper or silver.

9. The fuse element as claimed in claim 1, wherein the lateral sections are made of copper or silver.

10. The fuse element as claimed in claim 1, wherein the lateral sections are made of copper and the part of the central section with a high melting point is made of silver.

11. A method for the manufacture of the fuse element as claimed in claim 1, wherein its sections are formed and clad-welded together by rolling.

12. The method as claimed in claim 11, wherein the central section originates from a clad wire having a central core with a low melting point surrounded by a sheath with a high melting point.

13. The method as claimed in claim 11, wherein the central section originates from a composite wire formed from a bundle of strands with a low melting point that are embedded in a matrix with a high melting point.

14. The fuse element as claimed in claim 2, wherein the central section is composed of a core with a low melting point and a sheath with a high melting point surrounding said core.

15. The fuse element as claimed in claim 2, wherein the central section is composed of a bundle of strands with a low melting point and of matrix with a high melting point that surrounds said strands.

16. The fuse element as claimed in claim 2, wherein the part of the central section with a low melting point is mainly composed of tin.

17. The fuse element as claimed in claim 3, wherein the part of the central section with a low melting point is mainly composed of tin.

18. The fuse element as claimed in claim 4, wherein the part of the central section with a low melting point is mainly composed of tin.

19. The fuse element as claimed in claim 2, wherein the part with a low melting point takes up from 15 to 60% by weight of the central section.

20. The fuse element as claimed in claim 3, wherein the part with a low melting point takes up from 15 to 60% by weight of the central section.

21. The fuse element as claimed in claim 1, wherein at least one of said lateral sections and the high melting point part of said central section are made of different metallic materials.

22. The fuse element as claimed in claim 1, wherein the high melting point part of said central section is made of a softer material than a material of at least one of said two lateral sections, and said at least one lateral section has a convex edge fused by said weld to a corresponding concave edge of said central section.

* * * * *